US006353943B1

(12) United States Patent
Stevens

(10) Patent No.: US 6,353,943 B1
(45) Date of Patent: Mar. 12, 2002

(54) METHOD AND DEVICE FOR PROTECTING AGAINST BATHTUB SLIPS AND FALLS

(76) Inventor: Emeline A. Stevens, P.O. Box 1219, Gracie Station, New York, NY (US) 10028

( * ) Notice: Subject to any disclaimer, the term of this patent is extended or adjusted under 35 U.S.C. 154(b) by 0 days.

(21) Appl. No.: 09/250,583

(22) Filed: Feb. 12, 1999

(51) Int. Cl.[7] ..... A47K 3/02
(52) U.S. Cl. ..... 4/582
(58) Field of Search ..... 4/580, 581, 582, 4/583

(56) References Cited

U.S. PATENT DOCUMENTS 921,734 A * 5/1909 Pugh ..... 4/583
1,618,165 A * 2/1927 Boschelli ..... 4/583
1,865,459 A * 7/1932 Edmands ..... 4/581 X
2,217,821 A * 10/1940 Shiner ..... 4/583 X
2,268,747 A * 1/1942 Gaugler ..... 4/581

FOREIGN PATENT DOCUMENTS

GB 801867 * 9/1958 ..... 4/583
GB 2086721 * 5/1982 ..... 4/580

* cited by examiner

*Primary Examiner*—Robert M. Fetsuga
(74) *Attorney, Agent, or Firm*—R. Neil Sudol; Henry Coleman; William Sapone

(57) ABSTRACT

A flexible, absorbent, fabric mat or cover is removably affixed to a bathtub over the side or lip thereof. The fabric is advantageously terry cloth. Particularly where a bather's hand is wet or soapy, the coefficient of friction of the bathtub lip is substantially improved relative to an uncovered porcelain or enamel coated bathtub. Safety is improved even if the terry cloth inadvertently becomes saturated with water, and the device is readily removable for washing and readily washable.

8 Claims, 2 Drawing Sheets

METHOD AND DEVICE FOR PROTECTING AGAINST BATHTUB SLIPS AND FALLS

BACKGROUND OF THE INVENTION

This invention relates to home safety. More particularly this invention relates to a method and associated device for enhancing safety in the bathroom.

It is well known that a majority of personal injuries occur within the home. It is also well known that the bathroom represents one of the areas of increased hazard in the home. Slip and fall accidents in the bathroom are a particular concern of the elderly and invalids, and those who care for them. The bathroom represents an environment of simultaneously hard and smooth surfaces, which, particularly in a bathing area, may be in contact with skin whose coefficients of static and sliding friction for contact therewith has been diminished by a film of soap and water. Considering in addition the availability of scalding water, and of exposed plumbing fixtures with protruding parts, such as faucets, the bathroom almost seems especially designed for domestic hazard.

Numerous products are known to increase bathing safety. Specialized bars and grips may be permanently mounted in the vicinity of a bathtub. These products are expensive to purchase and install, and must be installed by skilled workers. Less expensive products are available, such as the ubiquitous 'rubber tub mat', manufactured from either a synthetic rubber or flexible plastic compound, and designed to be lain on the floor of a bathtub, possibly held in place by concave deformable elements known as "suction cups." Such devices are designed to improve footing inside the tub, by providing a surface with increased friction between a wet and possibly soapy foot, relative to the smooth porcelain or enamel tub surface. Such devices are reasonably effective, but unlike the more expensive hand-holds and bars, do nothing to provide improved manual holds for the bather and are less effective when the user is attempting to rise from a sitting position.

One particular source of danger in the bathtub is the smooth edge or lip thereof. The bathtub lip must be negotiated by a bather on entering or leaving the tub and is frequently gripped for support by a person attempting to rise unassisted from the waters of the bath. The smooth surface of the tub lip or side is particularly treacherous to a person whose hand may be wet or soapy. There is presently nothing in bathroom safety equipment which protects against slips or falls occasioned by a slippery tub lip. Safety handles or grip bars installed around a tub or toilet are not always within reach of a bather. Moreover, as noted above, such appurtenances are expensive and inconvenient to install. In many cases, handles or grips are not properly designed to provide an adequate gripping friction when engaged by wet or soapy hands. Furthermore, such bars still remain unpleasant to the user's touch and difficult to clean. A means of improving the tactile appeal of such objects to those who find them objectionable, or of compensating for design inadequacies in installed examples which for example may lack knurled or rubberized anti-skid surfaces, would also be of utility.

OBJECTS OF THE INVENTION

It is an object of this invention to provide a novel method of improving safety and comfort in the bathroom.

It is a more particular object of this invention to provide a novel method and device for improving the comfort and safety of a person whose skin may come into contact with an environmental bathroom surface, in order to brace or support that person.

Yet another object of the invention is provide such a device which is easy to clean.

These and other objects of the present invention will be apparent from the drawings and descriptions herein.

BRIEF DESCRIPTION

The present invention contemplates disposing a cover over a bathroom surface which a bather touches or attempts to grip in the course of ordinary bathing activities for purposes, for example, of repositioning his or her body among the bathroom fixtures and facilities. In particular, such contact is contemplated to include, but not be limited to 1) grasping a supporting bar installed in proximity to a toilet as a motion aid to the physically handicapped, 2) grasping or leaning upon the side or lip of a bathtub in the process of entering or exiting the tub for the purpose of bathing, 3) sitting upon the side or lip of such a tub preparatory to entering the tub for the purpose of bathing, or as an intermediate stage in exiting the tub at the completion of a bath. In particular, the present invention in a preferred embodiment contemplates temporarily affixing an absorbent fabric to such surfaces so that the user may grasp, rest on, or lean against such fabric. In a best mode, the fabric is contemplated to be a highly absorbent fabric with a coarse nap or pile, such as commonly used for toweling, which fabric may be generically by referred to as "terry cloth."

In a first embodiment of the present invention, a rectangular piece of terry cloth is draped or lain over the side or lip of a bathtub. The terry cloth is preferably provided on one side or major surface with one or more specialized attachment elements capable of releasable coupling to a smooth porcelain surface of the bathtub. The terry cloth and particularly these attachment elements are manipulated so as to attach the terry cloth to the bathtub. Generally, it is contemplated that the terry cloth is fastened to an outer surface of the tub, on one side of the lip or rim, and to an inner surface of the tub, on an opposite side of the lip.

In accordance with another feature of the present invention, the attachment elements are deformable resilient components or suction cups each provided on one side with at least a concave surface defining a recess which generates an underpressure or partial vacuum upon a pressing of the suction cups against a hard surface. If the surface is smooth, such as a porcelain surface, seals are formed about the peripheries of the suction cups. The consequent vacuum underpressure or partial vacuum arising as the deformable elements strain to return to an undeformed configuration under the action of internal spring forces serves to bind the suction cups and the piece of terry cloth to the bathtub.

It has been found that terry cloth material has adequate wet and dry friction both with a smooth bathtub surface, such as porcelain or baked enamel, and with human skin. In addition, terry cloth is highly absorbent and can wick substantial quantities of water and soap away from the user's hands and other body parts which come in contact with the material. Moreover, terry cloth is readily cleaned in the ordinary washing machine when the cloth becomes substantially laden with soap or otherwise soiled. Therefore, it is a highly suitable, and at the same time an unexpectedly useful, material for the present invention, since tub mats known in the nearest prior art and intended for disposition on the floor of a bathtub are made of specifically non-absorbent material such as a synthetic rubber, or flexible plastic.

It would not occur to one of ordinary skill in the art to manufacture a tub mat like device of terry cloth or other absorbent fabrics, since tub mats are subject to soaking conditions. In the present application, the device is disposed in a substantially dry location, above the bath water level. The wet and dry frictional properties of terry cloth, however, mean that the device maintains its safety functions even if it becomes inadvertently soaked with water.

To anchor the piece of terry cloth or other substantially flexible material to an outer surface of a tub side or lip, the fabric is provided with ideally at least four temporary or releasable fasteners. As discussed above, these fasteners preferably take the form of flexible cups of a rubber-like material which rely on maintenance of a seal and formation of a partial vacuum in response to reverse normal forces tending to pull the mat away from the tub. Alternative fastening devices include magnets, which are attracted to the ferrous core of a metallic tub, or loop and hook fasteners of the variety known as VELCRO™. In the latter case, half of each fastener pair would be affixed to the tub with permanent adhesive, allowing the tubmat to be removable.

In a further embodiment of the present invention, a smaller rectangular piece of terry cloth has dimensions approximating those of an ordinary washcloth. This rectangular cloth is provided with integral hook and loop fasteners suitable for self-affixing it in a wrapped configuration around a bar, such as a safety bar installed around a toilet for the comfort and convenience of the handicapped. Such a fabric rectangle improves the comfort of a user who grasps a cold safety bar with hands that are potentially wet. In such an installation, the device may of course be readily removed for washing, and readily so washed.

A bathroom safety device in accordance with the present invention is substantially conformable to the lip or rim of a bathtub, thus eliminating play between the mat and the tub surfaces and reducing insecurity of a user. In contrast, if a conventional rubber floor mat primarily designed for use in the tub bottom is draped over the lip or side of a bathtub, the mat is insufficiently flexible to conform to the contour of the tub side in order to obtain a good seal with suction cup attachment devices. Since the pressure exerted by a hand is generally less than that exerted by a foot, and resistance to sliding friction is typically proportional to the normal force expressed, a hand may be more likely to slide unexpectedly over a rubberized or plastic surface than a foot under similar conditions. Furthermore, the material of such mats is not absorbent, and any residue of soap and water on the gripping hand when the mat is used as a tub-side aid will remain interposed between the hand and the mat upon contact, decreasing the skin/mat coefficient of friction, in contradistinction to functioning on the bath floor, where either flooding by static bathwater or by moving shower waters tends to limit soap concentrations at the skin/mat interface. Furthermore, the absence of such routine inundation by bath or shower waters tends to allow the more rapid build up of soap film, decreasing the coefficients of friction with skin. Routine cleaning of such a semi-flexible mat, either in-situ or in a washing machine, may be difficult and hence irregular.

DESCRIPTION OF THE PREFERRED EMBODIMENTS

Figure 1:
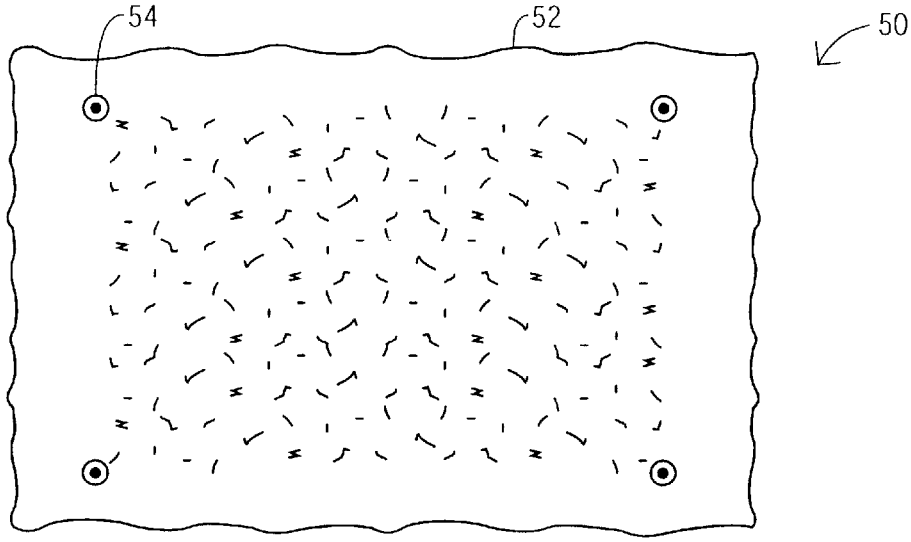
FIG. 1 is a schematic plan view of an absorbent mat in accordance with the present invention.

FIG. 1 illustrates an assembly 50 which is removably attachable to a bathtub, particularly at a rim or lip thereof, for purposes of safety enhancement or user protection. Assembly 50 comprises a fabric mat or substrate 52 provided with a plurality of temporary or releasably acting fasteners or attachment elements 54. Fasteners 54 are preferably deformable resilient components in the form of suction cups described in greater detail hereinafter with reference to FIG. 3. In some applications, fasteners 54 may take an alternative form such as magnets, hook and loop type fasteners commonly known as VELCRO™, or other such devices known in the art.

Figure 2:
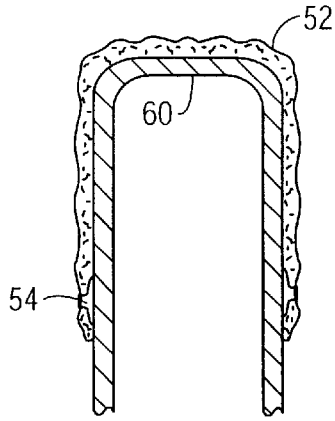
FIG. 2 is a sectional view of a side of a tub with the absorbent mat of FIG. 1 affixed thereto.

FIG. 2 sectionally illustrates the deployment of assembly 50 on a bathtub. Fabric mat 52 is conformally draped over a side or lip 60 of a bathtub 65 (see FIG. 4). After the draping of the fabric mat, suction cup fasteners 54 are pressed, through the fabric material of the mat, against the side of bathtub 65, thereby squeezing air out from the suction cups and forming air-tight seals between the respective suction cup fasteners 54 and the smooth porcelain surface of tub 65.

Figure 3:
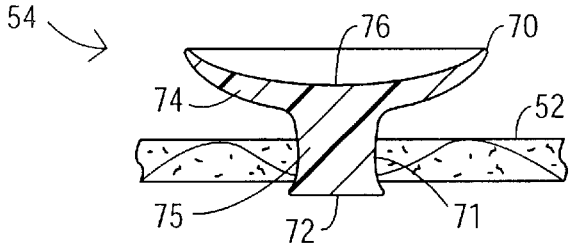
FIG. 3 is a sectional detail of a mat in accordance with the present invention, showing a releasably acting fastening device.

As shown in FIG. 1, suction cup fasteners 54 are four in number and are disposed at respective corners of fabric mat 52. As depicted in FIG. 3, suction cup fasteners 54 each include a cup body 74 and a stem or post 75. Post 75 passes through a hole or perforation 71 in fabric mat 52 and is attached to the mat by any means known in the art. For example, post 75 may be rigidly secured to a backing element or flange 72 by heat fusion or ultrasonic welding. Additionally, a grommet or other reinforcing device (not illustrated) may be disposed about perforation 71, as will readily occur to those skilled in the cloth arts.

As further depicted in FIG. 3, cup body 74 has a concave surface 76 surrounded by a rim or edge 70 and defining a substantially hemispherical recess (not separately designated) in a relaxed configuration of the cup body. The recess forms a vacuum chamber or suction space upon a pressing of cup body 74 against a porcelain surface of bathtub 65 and a subsequent release of the compressive force. Rim or edge 70 maintains a seal against the porcelain surface and prevents an influx of air back into the recess. The partial vacuum so generated in the recess of cup body 74 serves to secure mat 52 to the bathtub wall.

Figure 4:
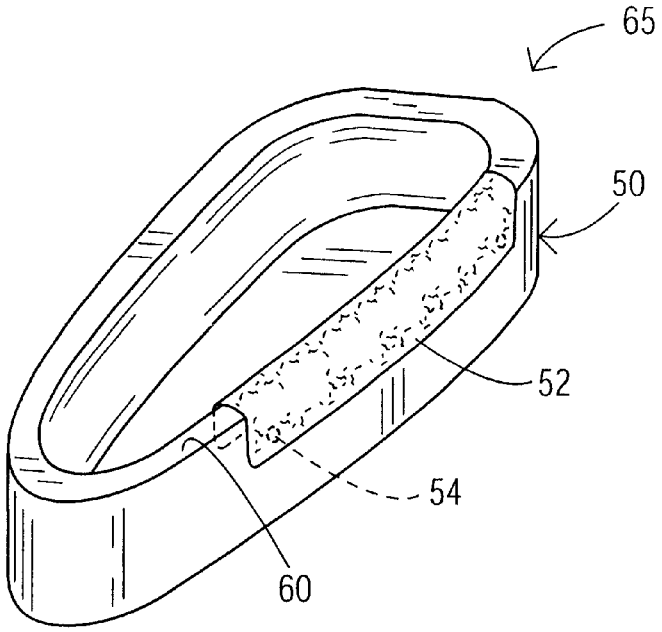
FIG. 4 is a schematic perspective view of a bathtub, showing the flexible and absorbent mat of FIGS. 1 and 2 draped over and affixed to a side or lip of the tub.

Disposition of assembly 50 is schematically illustrated in perspective in FIG. 4.

Figure 5:
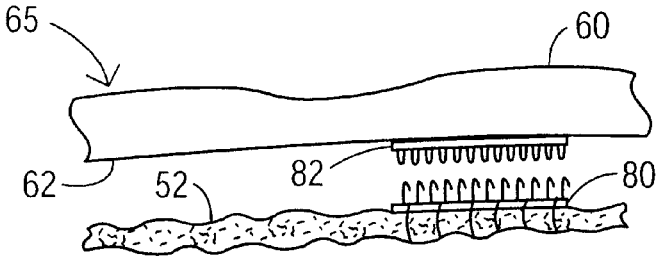
FIG. 5 is a schematic plan view illustrating an alternative method of attachment of a safety mat or cover to a bathtub.

FIG. 5 illustrates application of the well known hook and loop style of fastener (VELCRO™) to the present invention. A hook plate 80 is sewn onto fabric mat 52, while a loop plate 82 is affixed to a surface 62 of bathtub 65 with permanent adhesive (not shown).

Figure 6:
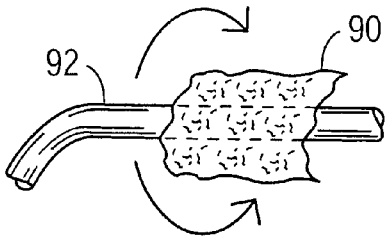
FIG. 6 is a schematic perspective view of another embodiment of the present invention, showing a method of wrapping a mat or grip around a bar.

In FIG. 6, in an embodiment of a safety device designed to be attached to a different environmental surface in a bathroom, a rectangular fabric piece 90 of reduced size is affixed to a cylindrical gripping surface 92, such as a bar-shaped grip, by means of hook and loop fasteners sewn into the same fabric swatch (not shown). The material of fabric piece 90 is preferably terry cloth. Fabric piece 90 may be provided on one major surface with friction enhancing formations such as doubled-over terry cloth strips (not shown), stitched to the fabric piece to form flaps which deformably roll over when pushed against gripping surface 92.

One of ordinary skill in the art will appreciate that materials and fasteners mentioned herein, and other equivalents in the art, may be modified to form further mats and coverings for environmental surfaces in the bathroom. For instance, an absorbent fabric backing may be lined on one or both sides with synthetic rubber protuberances.

Accordingly, it is to be understood that the drawings and descriptions herein are proffered by way of example to facilitate comprehension of the invention and disclose a best embodiment, and should not be construed to limit the scope thereof.

What is claimed is:

1. A device for enhancing bathroom safety, comprising;

a mat made solely of a textile material so as to be conformable, under gravitational forces, to a lip of a household bathtub and so as to be machine washable;

a plurality of suction cups disposed on a first major surface of said mat for resisting sliding motion between said mat and said lip; and said textile material having a second major surface opposite said first major surface capable of resisting sliding motion between the mat and a skin surface of a bather.

2. The device of claim 1, wherein said fabric material is terry cloth.

3. The device of claim 1, wherein said suction cups are at least four in number and are located at least at corners of said mat.

4. A device for enhancing bathroom safety, comprising;

a mat made solely of a textile material so as to be conformable, under gravitational forces, to a lip of a household bathtub and so as to be machine washable; and attachment means in the form of a plurality of suction cups on a first major surface of said mat for releasably attaching said mat to the bathtub on opposite sides of the lip of the bathtub.

5. The device of claim 4, wherein said suction cups are connected to said mat at spaced locations thereon.

6. The device of claim 5, wherein said suction cups are at least four in number and are located at least at corners of said mat.

7. A safety method for use in bathing, comprising:

placing a flexible and absorbent mat made solely of a textile material over the lip of a bath tub so that said mat substantially conforms to said lip;

releasably attaching said mat to said tub by means of suction cups attached to said textile material;

after the attaching of said mat to said tub, engaging said mat with a skin surface for support or balance on at least one of entering and exiting said tub;

after engaging said mat with said skin surface, removing said mat and said suction cups from said lip of said bathtub; and washing the removed mat and suction cups in a clothes washing machine.

8. A device for enhancing bathroom safety, comprising:

cover made solely of terry cloth material so as to be conformable to a curved surface of a household bathtub installation and so as to be machine washable, said terry cloth material having a high coefficient of sliding friction with a skin surface of a bather; and attachment means different from said terry cloth material on a first major surface of said cover for releasably attaching said cover to the curved surface, said attachment means being a plurality of suction cups attached to said terry cloth material.

* * * * *